US005590729A

United States Patent [19]

Cooley et al.

[11] Patent Number: 5,590,729

[45] Date of Patent: * Jan. 7, 1997

[54] SUPERHARD CUTTING STRUCTURES FOR EARTH BORING WITH ENHANCED STIFFNESS AND HEAT TRANSFER CAPABILITIES

[75] Inventors: Craig H. Cooley, Bountiful; Gordon A. Tibbitts, Salt Lake City; Wayne R. Hansen, Centerville, all of Utah

[73] Assignee: Baker Hughes Incorporated, Houston, Tex.

[ * ] Notice: The term of this patent shall not extend beyond the expiration date of Pat. No. 5,435,403.

[21] Appl. No.: 353,453

[22] Filed: Dec. 9, 1994

Related U.S. Application Data

[63] Continuation-in-part of Ser. No. 164,481, Dec. 9, 1993, Pat. No. 5,435,403.

[51] Int. Cl.[6] ..... E21B 10/46

[52] U.S. Cl. ..... 175/432

[58] Field of Search ..... 175/428, 431, 175/432, 434, 433

[56] References Cited

U.S. PATENT DOCUMENTS

| | | | |
|---|---|---|---|
| 3,727,704 | 4/1973 | Applanalp | 175/434 |
| 4,109,737 | 8/1978 | Bovenkerk . | |
| 4,303,136 | 12/1981 | Ball . | |
| 4,452,324 | 6/1984 | Jurgens . | |
| 4,478,297 | 10/1984 | Radtke . | |
| 4,478,298 | 10/1984 | Hake et al. . | |
| 4,525,179 | 6/1985 | Gigl . | |
| 4,606,418 | 8/1986 | Thompson . | |
| 4,629,373 | 12/1986 | Hall . | |
| 4,784,023 | 11/1988 | Dennis . | |
| 4,852,671 | 8/1989 | Southland . | |
| 4,858,707 | 8/1989 | Jones et al. . | |
| 4,872,520 | 10/1989 | Nelson . | |
| 4,902,073 | 2/1990 | Tomlinson et al. . | |
| 4,913,244 | 4/1990 | Trujillo . | |
| 4,913,247 | 4/1990 | Jones . | |
| 4,954,139 | 9/1990 | Cerutti . | |
| 4,984,642 | 1/1991 | Renard et al. . | |
| 4,997,049 | 3/1991 | Tank et al. . | |
| 5,007,207 | 4/1991 | Phaal . | |
| 5,011,515 | 4/1991 | Frushour . | |
| 5,025,874 | 6/1991 | Barr et al. . | |
| 5,027,912 | 7/1991 | Juergens . | |
| 5,028,177 | 7/1991 | Meskin et al. . | |
| 5,037,451 | 8/1991 | Burnand et al. . | |

(List continued on next page.)

FOREIGN PATENT DOCUMENTS

| | | |
|---|---|---|
| 0239328 | 9/1987 | European Pat. Off. . |
| 0317069A | 5/1989 | European Pat. Off. . |
| 0322214B | 6/1992 | European Pat. Off. . |
| 2212190 | 7/1989 | United Kingdom . |

OTHER PUBLICATIONS

Republic of South Africa Provisional Specification entitled "Composite Abrasive Compact" for De Beers Industrial Diamond Division Limited, Dec. 23, 1992.

"Electrical and thermal conductivity," pp. 328 and 332, undated.

*Primary Examiner*—William P. Neuder

*Attorney, Agent, or Firm*—Trask, Britt & Rossa

[57] ABSTRACT

A cutting element for a rotary drill bit for subterranean drilling, including a substantially planar table of superhard material having a cutting face and a cutting edge. The table may be reinforced against bending with one or more strut portions extending from the rear of the table to the rear of the substrate and at least partially across the cutting element. The strut portions may be integral with the diamond table, or separately fabricated and of another material. The strut portions, in addition to or in lieu of providing stiffness to the superhard table, may also serve to enhance heat transfer away from the cutting face and cutting edge of the superhard table. The structure supporting the cutting element on the drill bit and the body of the drill bit itself may be additionally configured to include structures to facilitate heat transfer away from the superhard table.

41 Claims, 6 Drawing Sheets

U.S. PATENT DOCUMENTS 5,054,246 10/1991 Phaal et al. .
5,120,327 6/1992 Dennis .
5,172,778 12/1992 Tibbitts et al. .
5,217,081 6/1993 Waldenstrom et al. .
5,273,125 12/1993 Jurewicz ..... 175/420.2
5,301,762 4/1994 Besson .
5,316,095 5/1994 Tibbitts .
5,351,772 10/1994 Smith .
5,421,425 6/1995 Griffin ..... 175/432

SUPERHARD CUTTING STRUCTURES FOR EARTH BORING WITH ENHANCED STIFFNESS AND HEAT TRANSFER CAPABILITIES

This application is a continuation-in-pan of U.S. patent application Ser. No. 08/164,481, filed Dec. 9, 1993, now U.S. Pat. No. 5,435,403.

BACKGROUND OF THE INVENTION

1. Field of the Invention

The present invention relates generally to the structure of cutting elements for drill bits for subterranean drilling, and more specifically to cutting elements including cutting surfaces of superhard material, the cutting elements being structured via configuration of the superhard material in combination with that of a supporting structure to provide superior stiffness for the superhard material and enhanced heat transfer from the cutting surface to and through the supporting structure.

2. State of the Art

Superhard materials, normally diamond, have been employed in cutting elements for rotary drill bits for decades. For about the past twenty years there has been widespread use of synthetic diamond cutters, specifically in the form of polycrystalline diamond compacts. Polycrystalline diamond compact cutting elements, commonly known as PDC's, have been commercially available for over 20 years. PDC's may be self-supporting or may comprise a substantially planar diamond table bonded during formation to a supporting substrate. A diamond table/substrate cutting element structure is formed by stacking into a cell layers of fine diamond crystals (100 microns or less) and metal catalyst powder, alternating with wafer-like metal substrates of cemented tungsten carbide or other suitable materials. In some cases, the catalyst material may be incorporated in the substrate in addition to or in lieu of using a powder catalyst intermixed with the diamond crystals. A loaded receptacle is subsequently placed in an ultrahigh temperature (typically 1450°–1600° C.) ultrahigh pressure (typically 50–70 kilobar) diamond press, wherein the diamond crystals, stimulated by the catalytic effect of the metal power, bond to each other and to the substrate material. The spaces in the diamond table between the diamond to diamond bonds are filled with residual metal catalyst. A so-called thermally stable PDC product (commonly termed as TSP) may be formed by leaching out the metal in the diamond table. Alternatively, silicon, which possesses a coefficient of thermal expansion similar to that of diamond, may be used to bond diamond particles to produce an Si-bonded TSP. TSP's are capable of enduring higher temperatures (on the order of 1200° C.) without degradation in comparison to normal PDC's, which experience thermal degradation upon exposure to temperatures of about 750°–800° C.

While PDC and TSP cutting elements employed in rotary drag bits for earth boring have achieved major advances in obtainable rate of penetration while drilling and in greatly expanding the types of formations suitable for drilling with diamond bits at economically viable cost, the diamond table/substrate configurations of state of the art planar cutting elements leave something to be desired.

First, bending attributable to the loading of the cutting element by the formation may cause fracture or even delamination of the diamond table from the substrate. It is believed that such degradation of the cutting element is due at least in part to lack of sufficient stiffness of the cutting element so that, when encountering the formation, the diamond table actually flexes due to lack of sufficient rigidity or stiffness. As diamond has an extremely low strain to failure (diamond cannot tolerate large values of absolute strain), only a small amount of flex can initiate fracture. In addition, fracture may also be initiated in the highly stressed carbide substrate when cutting loads are applied to the cutting element. The carbide is stressed in tension during cooling after the previously-described fabrication process, due to the difference in coefficients of thermal expansion between the diamond and the substrate material.

A second limitation of PDC's is due to excessive buildup of heat due to frictional forces generated during the cutting process. While the superhard material of the cutting element table has an extremely high thermal conductivity (on the order of 400 to over 600 watts/meter Kelvin) and the substrate has a relatively high thermal conductivity (on the order of 100 watts/meter Kelvin), the bit body, typically steel or WC matrix, has a far lower thermal conductivity (on the order of 30 watts/meter Kelvin). As the cutting element wears and the point of contact with the formation becomes an ever-wider wear flat, the cutting element is subjected to higher cutting energies and the substrate becomes ever-smaller, limiting and actually reducing the potential rate of heat transfer. The heat buildup causes overheating of the cutting element and accelerated wear of the diamond table and supporting substrate. In "dull" or used bits, such excessive heating is often manifested on the WC substrate behind the diamond table by the phenomenon of "heat checking", which comprises vertically running fractures in a checkerboard pattern.

It has been proposed to enhance the stiffness of superhard cutting elements by providing the superhard table with a linearly-extending portion of enhanced thickness. Such a configuration provides additional stiffness for the cutting structure, and also beneficially increases compressive stresses in the superhard material table while lowering tensile stresses in the supporting substrate. A number of variations of this approach are described in co-pending U.S. patent application Ser. No. 08/164,481 to Gordon A. Tibbitts, assigned to the assignee of the present invention and incorporated herein by this reference.

It has been proposed to promote heat transfer from a PDC element to the underlying bit structure in U.S. Pat. No. 4,478,297, issued to Robert P. Radtke and assigned on its face to Strata Bit Corporation. The Radtke patent proposed to use a hollow cylindrical stud with a recess extending into about the middle of the stud from the bottom thereof, the recess being filled with a soft, heat-conducting metal to facilitate heat transfer from the PDC at the upper or outer end of the stud.

However, despite the above-referenced developments, it is believed by the inventors that both cutting element stiffness and heat transfer capabilities can be significantly enhanced via the invention described and claimed herein.

SUMMARY OF THE INVENTION

In a first embodiment, the present invention comprises a cutting element including a substantially planar table of superhard material with at least one integral rearwardly-extending elongated strut member, which strut member may also extend laterally from one side to the other of the table. The rearwardly-extending strut member may or may not be diametrically located, and may comprise a plurality of laterally adjacent parallel, convergent or divergent struts, a plurality of radially-extending struts, or a single diametrical strut. The strut member may also comprise one or more rings of superhard material surrounded by an outer ring of substrate material, separated by substrate material, and surrounding a center core of substrate material. The strut member reinforces the superhard table against cutting loads which would otherwise give rise to bending stresses in the table as it curves or bends under the loads in the manner of a cantilever beam. The superhard table, strut member and supporting substrate, if one is employed, are cooperatively configured to place the superhard material in compression and to minimize the tensile stresses in the substrate.

In another embodiment, the present invention comprises a cutting structure employing heat transfer members which extend from the substantially planar table of superhard material to the structure supporting the cutting element or even into the body of the bit. The heat transfer members may be formed of the superhard material, or of another material which contacts or is immediately adjacent the superhard table, and which may also be in contact with the substrate. For example, the heat transfer members may comprise fins of a highly heat-conductive material extending from the rear of the superhard table rearwardly through the substrate and into a carrier structure such as a cylinder or stud. Alternatively, the substrate may be grid-like in configuration with apertures extending from the rear of the superhard table, the apertures being filled with a material to enhance heat transfer. Yet another alternative involves the use of a heat transfer structure contacting part of the periphery of the diamond table and preferably also the substrate and carrier structure and extending into the bit body, a preferred design for such being in the form of a cradle or receptacle embracing the underside of the cutting structure and including cooling fans extending into the bit body. It is also contemplated that cooling channels or passages may be employed within the bit body, and that the aforementioned cooling fins may extend at least partially into these channels or into a plenum within the bit body. Another suitable arrangement for enhanced cooling comprises cooling channels communicating from a plenum within the bit body into the interior of the cutting element.

In yet another embodiment, aspects of both of the foregoing embodiments are combined to provide a cutting structure with the desired enhanced stiffness and superior heat transfer characteristics.

DETAILED DESCRIPTION OF THE ILLUSTRATED EMBODIMENTS

Figure 1A:
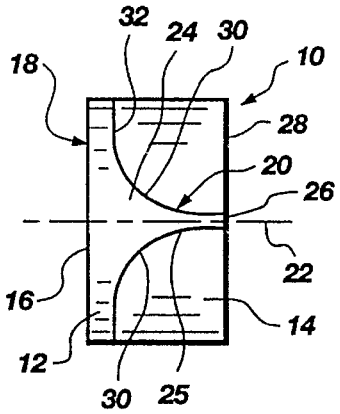
FIGS. 1A and 1B are respective top and side elevations of a first variation of a first preferred cutting element embodiment of the invention, FIG. 1B having a portion of the substrate material removed.
Figure 1B:
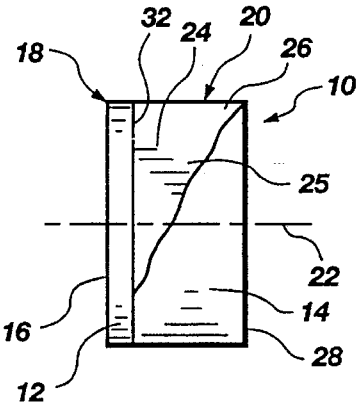

FIGS. 1A and 1B of the drawings depict cutting element 10 including a substantially planar, circular table 12 of superhard material of, for example, PDC, TSP, diamond film or other suitable superhard material such as cubic boron nitride. Table 12 is backed by a supporting substrate 14 of, for example, cemented WC, although other materials have been known and used in the art. Table 12 presents a substantially planar cutting surface 16 having a cutting edge 18, the term "substantially planar" including and encompassing not only a perfectly flat surface or table but also concave, convex, ridged, waved or other surfaces or tables which define a two-dimensional cutting surface surmounted by a cutting edge. Integral elongated strut portion 20 of superhard material projects rearwardly from table 12 to provide enhanced stiffness to table 12 against loads applied at cutting edge 18 substantially normal to the plane of cutting surface 16, the resulting maximum tensile bending stresses lying substantially in the same plane as cutting surface 16. In this variation of the invention, elongated strut portion 20 is configured as a single, diametrically-placed strut. Cutting element 10 is rotationally oriented about its axis 22 on the drill bit on which it is mounted so that elongated strut portion 20 is placed directly under the anticipated cutting loads. The strut thus serves to stiffen the superhard table against flexure and thereby reduces the damaging tensile portion of the bending stresses. The orientation of the plane of the strut portion 20 may be substantially perpendicular to the profile of the bit face, or at any other suitable orientation dictated by the location and direction of anticipated loading on the cutting edge 18 of the cutting element 10. As shown in FIG. 1A, strut portion 20 includes a relatively wide base 24 from which it protrudes rearwardly from table 12, tapering to a web 25 terminating at a thin tip 26 at the rear 28 of substrate 14. Optionally, tip 26 may be foreshortened and so does not extend completely to the rear 28 of substrate 14. Arcuate strut side surfaces 30 extending from the rear 32 of table 12 reduce the tendency of the diamond table/strut junction to crack under load, and provide a broad, smooth surface for substrate 14 to support.

Upon cooling of cutting element 10 after fabrication, the differences in coefficient of thermal expansion between the material of substrate 14 and the superhard material of table 12 and strut portion 20 result in relative shrinkage of the substrate material, placing the superhard material in beneficial compression and lowering potentially harmful tensile stresses in the substrate 14.

Figure 4:
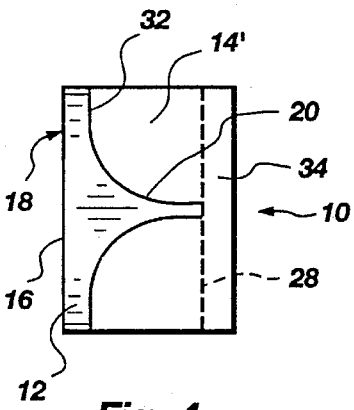
FIG. 4 is a top elevation of an intermediate product from which the first variation of the first preferred embodiment may be cut.

As shown in FIG. 4, cutting element 10 may be formed with a one-piece substrate blank 14' for the sake of convenience when loading the blanks and polycrystalline material into a cell prior to the high-temperature and high pressure fabrication process. The rear area 34 of blank 14' may then be removed by means known in the art, such as electro-discharge machining (EDM) to achieve the structure of cutting element 10, with elongated strut portion 20 terminating at the rear 28 of substrate 14. Alternatively, as noted above, rear area 34 may remain in place, covering the tip 26 of strut portion 20.

Figure 2:
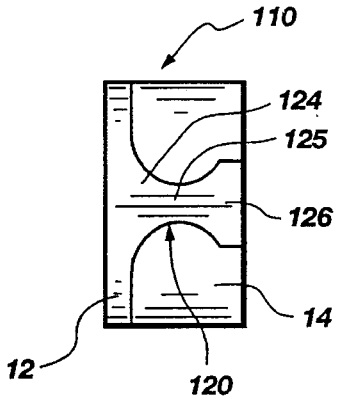
FIG. 2 is a top elevation of another modification of the variation of FIGS. 1A and 1B.

FIG. 2 depicts an alternative cutting element configuration 110, wherein the strut portion 120 extending from superhard table 12 includes a laterally-enlarged tip 126 after narrowing from an enlarged base portion 124 to an intermediate web portion 125. This configuration, by providing enlarged tip 126, may be analogized to an I-beam in its resistance to bending stresses. From the side, cutting element 110 would be indistinguishable from cutting element 10.

Figure 3:
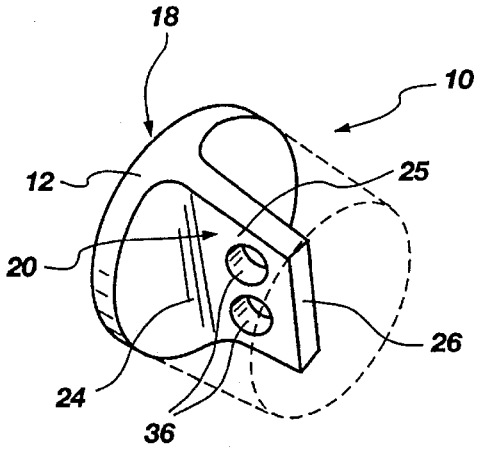
FIG. 3 is a perspective view of the rear of the superhard material table of yet another structural modification of the variation of FIGS. 1A and 1B.

FIG. 3 depicts a cutting element 10 from a rear perspective with substrate 14 stripped away to reveal transverse cavities or even apertures 36 extending through web 25 of strut portion 20. Cavities or apertures 36 enhance bonding between the superhard material and the substrate material, and further enhance the compression of the superhard material as the cutting element 10 cools after fabrication.

Figure 5:
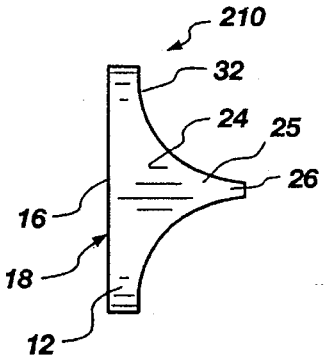
FIG. 5 is a top elevation of an unbacked version of the first variation of the first preferred embodiment.

FIG. 5 depicts a diamond table 12 and strut portion 20 configuration similar to that of FIGS. 1A and 1B, forming cutting element 210. Cutting element 210 may comprise a PDC or preferably a TSP which is furnaced or otherwise directly secured to a bit face or supporting structure thereon, without the use of a substrate 14. It may be preferred to coat cutting element 210, and specifically the rear 32 of diamond table 12 as well as the side surfaces of base 24 and web 25 with a single- or multi-layer metal coating in accordance with the teachings of U.S. Pat. No. 5,030,276 or U.S. Pat. No. 5,049,164, each of which is hereby incorporated herein by this reference, to facilitate a chemical bond between the diamond material and the WC matrix of the drill bit or between the diamond material and a carrier structure secured to the drill bit.

Figure 15:
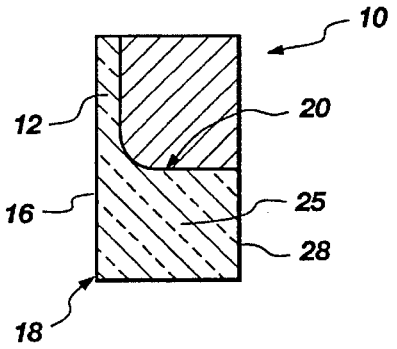
FIG. 15 is a side sectional elevation of a variation of the cutting element of FIGS. 1A and 1B, having a strut portion extending only partially across the substrate.

FIG. 15 depicts a cutting element 10 having a diamond or other superhard table 12 extending into a strut portion 20 which is defined by a web 25 extending only partially across cutting element 10, from table 12 to the rear 28 of substrate 14. Such a partial strut, if oriented properly with cutting loads applied at the lower left-hand cutting edge 18 (as shown) of the cutting element 10, will provide useful enhanced stiffness to table 12.

At this point, it should be noted that the structures depicted in FIGS. 1–5 and 15 of the drawings, in addition to enhancing stiffness of the superhard table, also promote heat transfer away from the table 12 and specifically cutting edge 18. Superhard materials, such as PDC's and TSP's, are excellent heat conductors and far superior to the cemented carbide of substrate 14. Thus, strut portions 20 provide a conduit for heat transfer away from cutting face 16 and cutting edge 18 which avoids the limitations imposed by substrate 14. As previously noted, heat transfer problems become more serious as the table 12 and substrate 14 wear and more frictional heat is generated, while at the same time the cutting element's heat transfer capabilities are reduced. Strut portion 20 may also act as a conduit for excess heat from table 12 to another, separate heat transfer structure such as is later disclosed herein. Further, the presence of strut portion 20 permits heat transfer from the top and rear of the strut portion to the borehole environment with a suitable mounting structure for the cutting element on the bit face. The strut portion also acts as a conduit for heat transfer to the bit body, which acts as a heat sink and which may be more easily cooled with the flow of drilling fluid therethrough.

Figure 6:
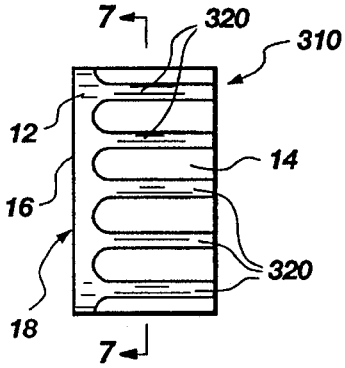
FIG. 6 is a top elevation of a second variation of the first preferred embodiment of the invention.
Figure 7:
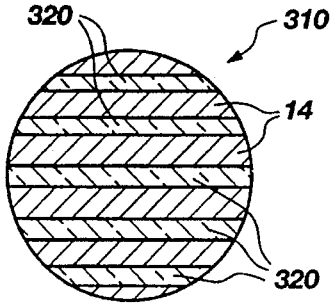
FIG. 7 is a section taken across line 7—7 in FIG. 6.

FIGS. 6 and 7 depict a cutting element 310 wherein strut portion 20 comprises a plurality of vertically-extending struts 320, struts 320 being integrally formed with superhard material table 12 of the same material. Struts 20 are preferably oriented in the same manner as strut portion 20 of FIGS. 1–5, that it to say, to provide the maximum resistance to table 12 against bending stress. The plurality of struts 320 provide added stiffness across the lateral extent of cutting face 16, and may also serve to expedite heat transfer from cutting face 16 and cutting edge 18. As previously noted, struts 320 may be placed in contact with another heat-conductive structure to further remove excess heat from the cutting element, or may serve to transfer heat away from the table 12 and into the surrounding environment via the top and rear of the struts 320.

Figure 8:
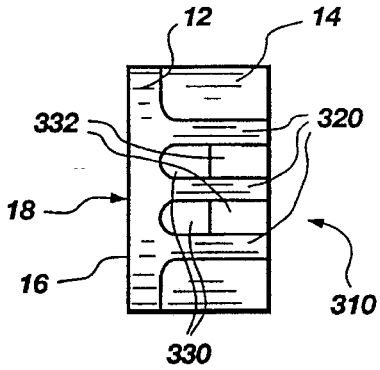
FIG. 8 is a top elevation of a modification of the structure of FIG. 6, including cooling channels adjacent the rear of the superhard table.

FIG. 8 depicts a modification of the cutting element 310 of FIGS. 6 and 7, wherein channels or passages 330 are formed between the rear of diamond table 12 and a rear portion 332 of substrate 14 between the webs of at least two of the struts 320. Drilling fluid may then be pumped through passages 330 from a plenum or other reservoir within the drill bit on which cutting element 310 is mounted to cool the table 12 in a very effective manner. In some respects, this structure is similar to that described in U.S. Pat. No. 5,316,095, but is believed to be far more efficient due to the greatly increased superhard material surface area of the strut webs exposed to the drilling fluid flow. In addition, unlike the cutting elements of the '095 patent, struts 320 provide the aforementioned enhanced stiffness against bending of table 12.

Figure 23:
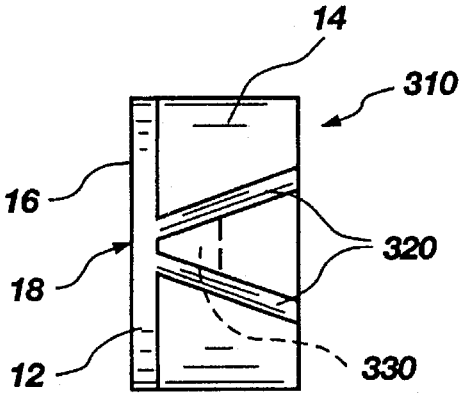
FIGS. 23 and 24 comprise top elevations of two additional multi-strut variations of the cutting element of the present invention.
Figure 24:
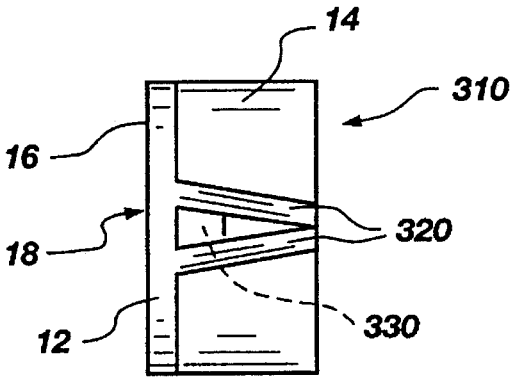

FIGS. 23 and 24 depict two more variations of cutting element embodiment 310, wherein the struts 320 are either divergent (FIG. 23) or convergent (FIG. 24), rather than parallel. Such strut arrangements both enhance stiffness of the diamond table 12 and offer enhanced heat transfer characteristics due to the multiple-strut design. In addition, if desired, cooling channels or passages 330 (shown in broken lines) may be located between the struts 320 to the rear of the diamond table, as with the variation of FIG. 8.

Figure 9:
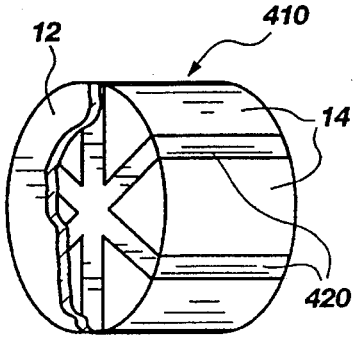
FIG. 9 is a partial sectional front perspective view of a third variation of the first preferred embodiment of the invention.

FIG. 9 depicts yet another cutting element 410 according to the present invention, wherein superhard table 12 is backed by a plurality of radially-oriented struts 420 disposed in substrate 14, struts 420 extending to the rear of substrate 14. With the arrangement of cutting element 410, rotational orientation of cutting element 410 on the bit face is less critical than in the previous embodiments, due to the radial projection of struts 420. The previously-mentioned heat transfer advantages also apply.

Figure 10:
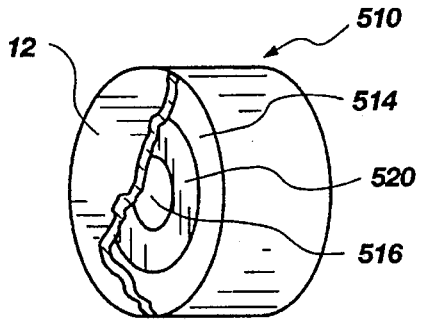
FIG. 10 is a partial sectional front perspective view of a fourth variation of the first preferred embodiment of the invention.

The embodiment 510 of FIG. 10 configures strut portion 20 as an annular plug 520 which is surrounded by an outer substrate ring 514 and which surrounds an inner substrate cylinder 516. This arrangement provides excellent heat transfer and some enhanced stiffness against bending stresses regardless of rotational orientation.

Figure 16:
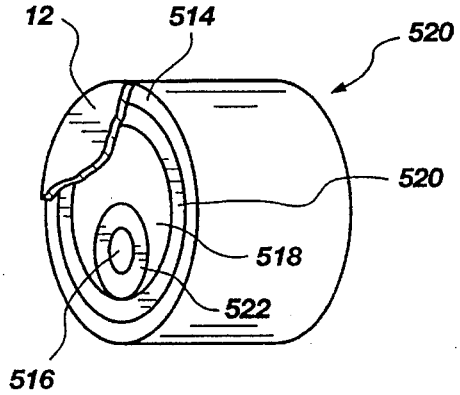
FIG. 16 is a partially-sectioned perspective view of a variation of the cutting element embodiment of FIG. 10.

The embodiment 510 of FIG. 16 also configures strut portion 20 as an annular plug 520 surrounded by an outer substrate ring 514 and which surrounds an inner substrate crescent 518 which in turn surrounds a second annular plug 522, the latter encompassing an inner substrate cylinder 516. This arrangement provides stiffness to superhard table 12 superior to that of FIG. 10, and also greater heat transfer capability if the eccentricity of the superhard material of the plugs 520 and 522 concentrates this material closer to the cutting edge 18.

Figure 11:
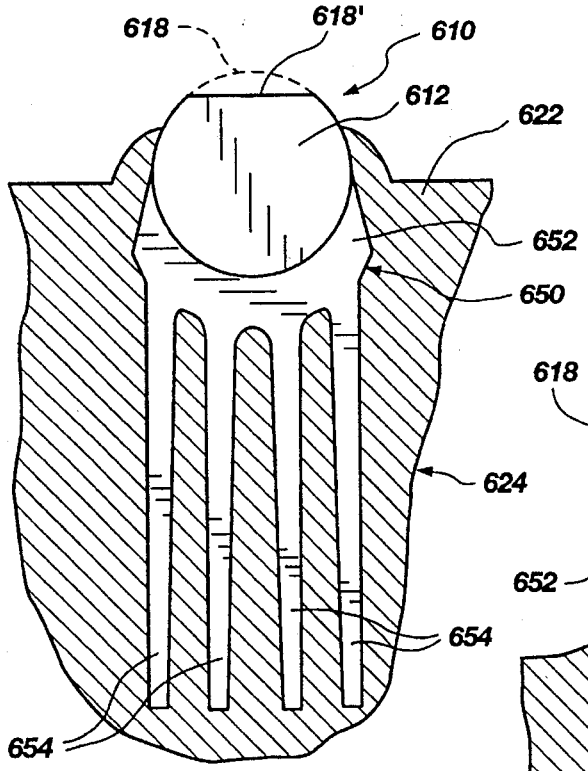
FIG. 11 is a front, partial sectional elevation of a first variation of a second preferred cutting structure embodiment of the invention.
Figure 12:
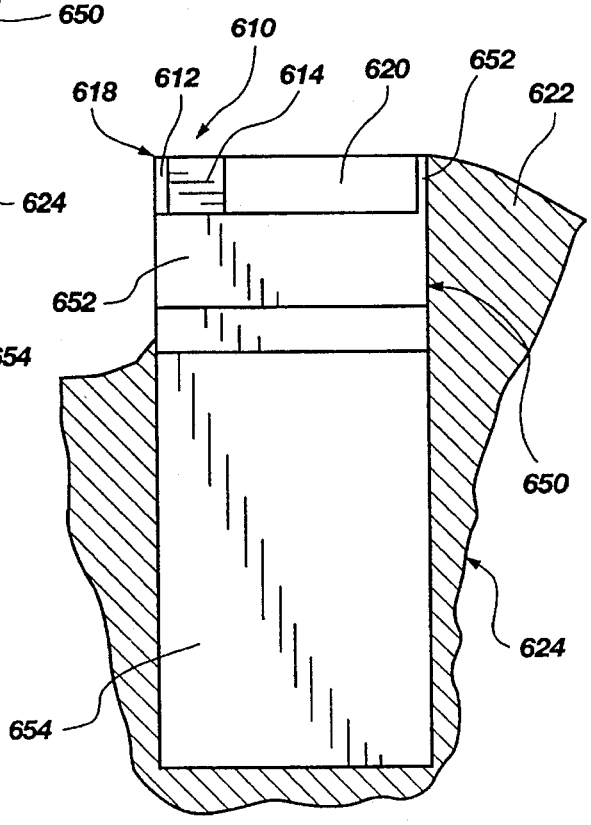
FIG. 12 is a side, partial sectional elevation of the structure depicted in FIG. 11.

FIGS. 11 and 12 depict a conventional, state of the art PDC cutting element 610 comprising a diamond table 612 and WC substrate 614. Substrate 614 is bonded by means known in the art, such as brazing, to the front of cylindrical cutting element support 620, support 620 having been furnaced into the body 622 of the bit 624 on which cutting element 610 is mounted during fabrication of the bit 624. As shown, support 620 is encompassed at the rear and sides by bit body material, such as a copper-infiltrated WC matrix. Heat transfer structure 650 comprising heat transfer cradle 652 and heat dissipation elements 654, is also placed in bit body 622 during fabrication. Cradle 652 preferably extends the length of the assembly of diamond table 612, substrate 614, and cylindrical support 620, and may include a rear wall 656. The inner surfaces of cradle 652 and rear wall 656 provide relatively large areas for heat transfer from the superhard table 612, substrate 614 and support 620. Heat transfer cradle 652 and elements 654 may be formed of the same material, or of different materials. Any suitable material providing high heat conductivity may be employed, such as, for example, copper, nickel, silver, gold, platinum, lead, molybdenum, tin, bismuth, antimony, graphite and their alloys. With this arrangement, even as cutting edge 618 of diamond table 612 wears into a flat 618' and the substrate 614 and support 620 are similarly worn, heat transfer from the overall cutting structure continues substantially undiminished due to the presence of structure 650. Elements 654 may be configured as fins to provide additional surface area for heat transfer to bit body 622.

Figure 17:
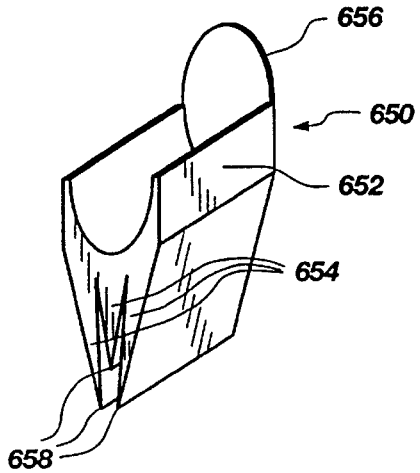
FIG. 17 is a perspective of a variation of the heat transfer structure depicted in FIGS. 11 and 12.

FIG. 17 depicts an alternative embodiment of heat transfer structure 650, wherein fin-like elements 654 are convergent at their distal ends 658 to facilitate close lateral placement of a plurality of heat transfer structures 650 along the curved profile of a bit body.

Figure 13A:
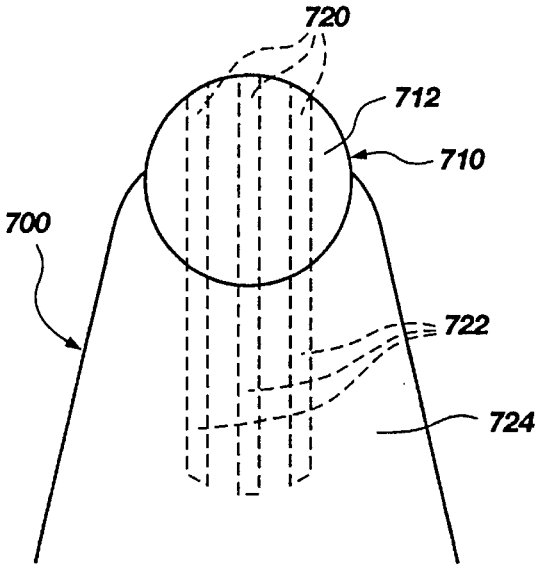
FIGS. 13A, 13B and 13C are respective front, side and top elevations of a second variation of the second preferred embodiment of the invention.
Figure 13B:
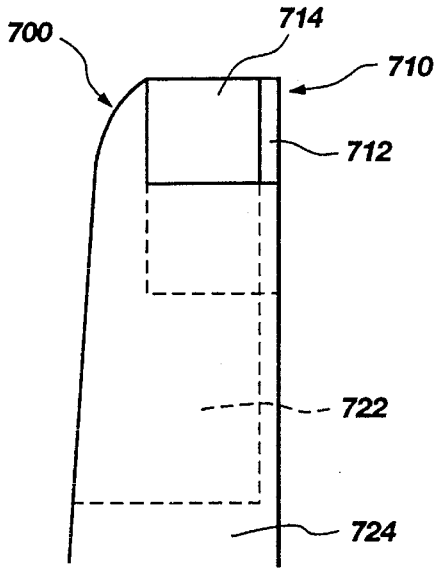
Figure 13C:
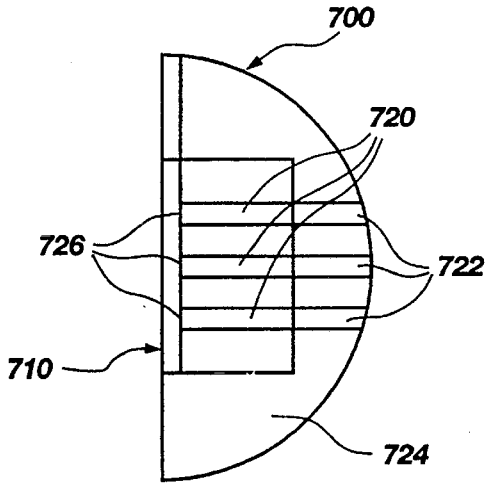

FIGS. 13A, 13B and 13C depict a cutting structure 700 including a cutting element 710 which is similar to that of FIG. 6. However, fins 720 may not necessarily be integral with diamond table 712, but may merely comprise members in contact with or very near to the rear of diamond table 712, which members have heat transfer characteristics superior to that of the material of substrate 714 and which may or may not also provide a stiffening effect. The forward portions 726 of fins 720 may even extend into slight depressions or shallow grooves in the rear of diamond table 712. If desired, the fins 720 may contact similarly-aligned heat transfer elements 722 extending into the body of supporting stud 724 and to the rear extent of stud 724. Another and preferred alternative is for fins 720 to extend rearwardly and downwardly to form larger, one-piece fins including the segments designated as 720 and 722 in the drawings.

Figure 14A:
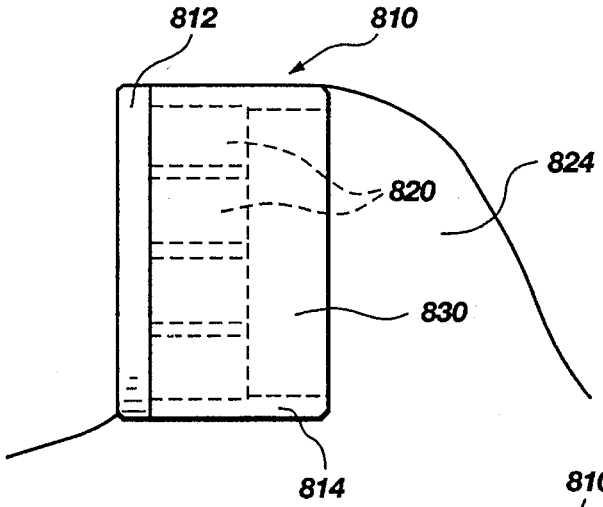
FIGS. 14A and 14B are respective side and front elevations of a third variation of the second preferred embodiment of the invention, FIG. 14B having the superhard material table removed from the substrate.
Figure 14B:
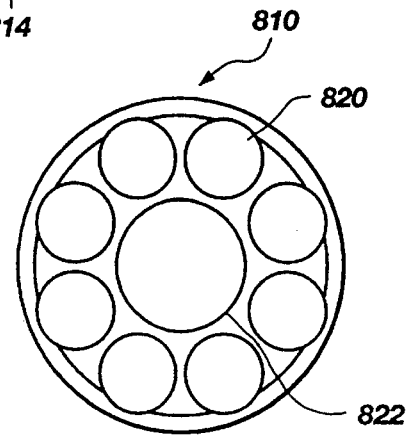

FIGS. 14A and 14B depict yet another cutting element 810, wherein a superhard table 812 such as a PDC or TSP table is supported by a grid-like substrate 814 having a plurality of longitudinally-oriented peripheral apertures 820 and a central aperture 822. Apertures 820 and 822 are filled with a highly heat-conductive material such as previously described, while substrate 814 provides the required rigidity against bending stresses. The entire rear 830 of substrate 814, behind apertures 820 and 822, may also be filled with an excellent heat conductor which can transfer heat to the surrounding bit body 824. In the arrangement of FIGS. 14A and B, the diamond table may be made free-standing, and then brazed or otherwise bonded to substrate 814 to facilitate the manufacturing process.

It should be understood that the terms "heat transfer elements" or "heat dissipation elements" contemplates not only conductive heat transfer but also convective heat transfer. A Beryllium-Copper material may be used as a conductive material, or in some applications it may be desirable to employ a sodium-filled hollow structure such as tubes or pipes as elements 654 or in other arrangements to effect convective heat transfer.

Figure 18:
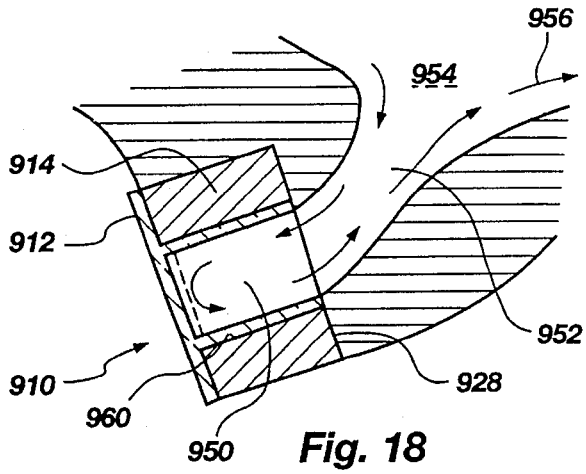
FIGS. 18 and 19 are side sectional elevations of variations of a cutting element including a blind cavity therein for enhanced heat transfer via drilling fluid flow from the bit body plenum, as illustrated.
Figure 19:
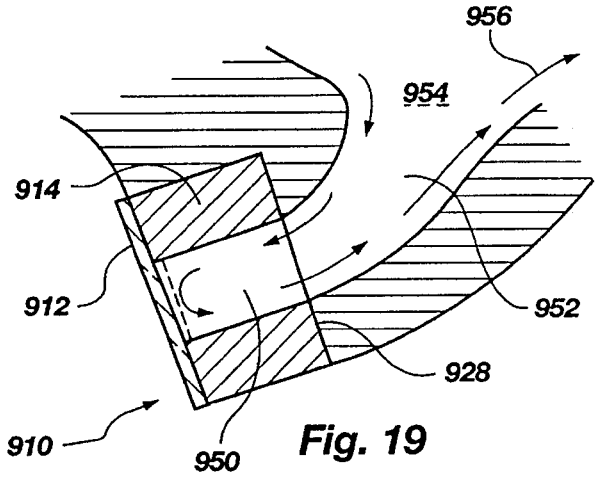

FIGS. 18 and 19 depict variations of yet another cutting structure including hollow cutting elements 910. Elements 910 each include a superhard material table 912 backed by a substrate 914, the substrate including a cavity 950 thereon which extends from the rear 928 of the substrate 9 14 to a location at the rear of the table 912 or a location closely adjacent thereto, as shown in broken lines on the figures. Cavities 950 of cutting elements 910 communicate via passages 952 with plenums 954 on the interior of the bit body. Fluid flow of drilling fluid is directed into passages 952 as shown by arrows 956 via suitable means such as baffles (not shown). The flow picks up heat from the table 912 and substrate 914, and removes it to a remote location on the bit, when the fluid is discharged, as via nozzles, to remove formation cuttings. The primary difference between the cutting element 910 of FIG. 18 and that of FIG. 19 is the presence in FIG. 18 of integral superhard sleeve 960 which extends rearwardly from table 912 and lines or at least partially lines cavity 950. Cavity 950 may be concentric or nonconcentric, and may be of non-circular configuration, as desired.

Figure 20:
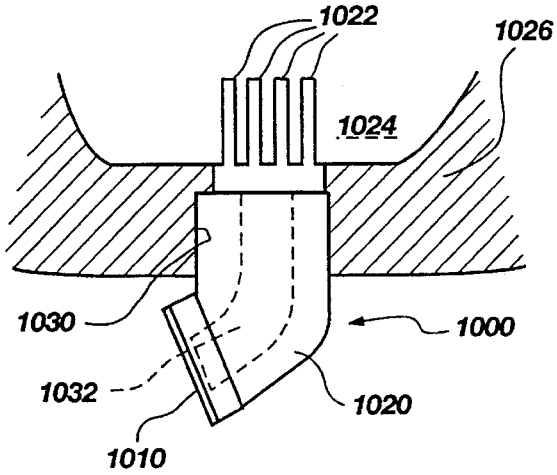
FIG. 20 is a side, partial sectional elevation of a cutting element carrier structure including heat transfer means for carrying heat away from the cutting element and into contact with drilling fluid in a bit body plenum.

FIG. 20 depicts a cutting structure 1000 including a cutting element 1010 mounted on a carrier structure 1020 such as a stud, although a cylinder is equally suitable. Stud 1020 includes a plurality of heat dissipation elements 1022 in the shape of fins, which elements 1022 extend into a plenum 1024 in bit body 1026, where they are exposed to a flow of drilling fluid in a direction vertical to the plane of the drawing sheet. Stud 1020 is press-fit, brazed or otherwise secured in aperture 1030 in bit body 1026 during fabrication, and in some cases may be cast in place as a preform. If desired, a special heat-conductive core 1032 may be employed in stud 1020, core 1032 extending from proximate or even within cutting element 1010 to fins 1022, which may be formed of the same or another highly conductive material. Of course, other configurations of elements 1022 may be employed.

Figure 21:
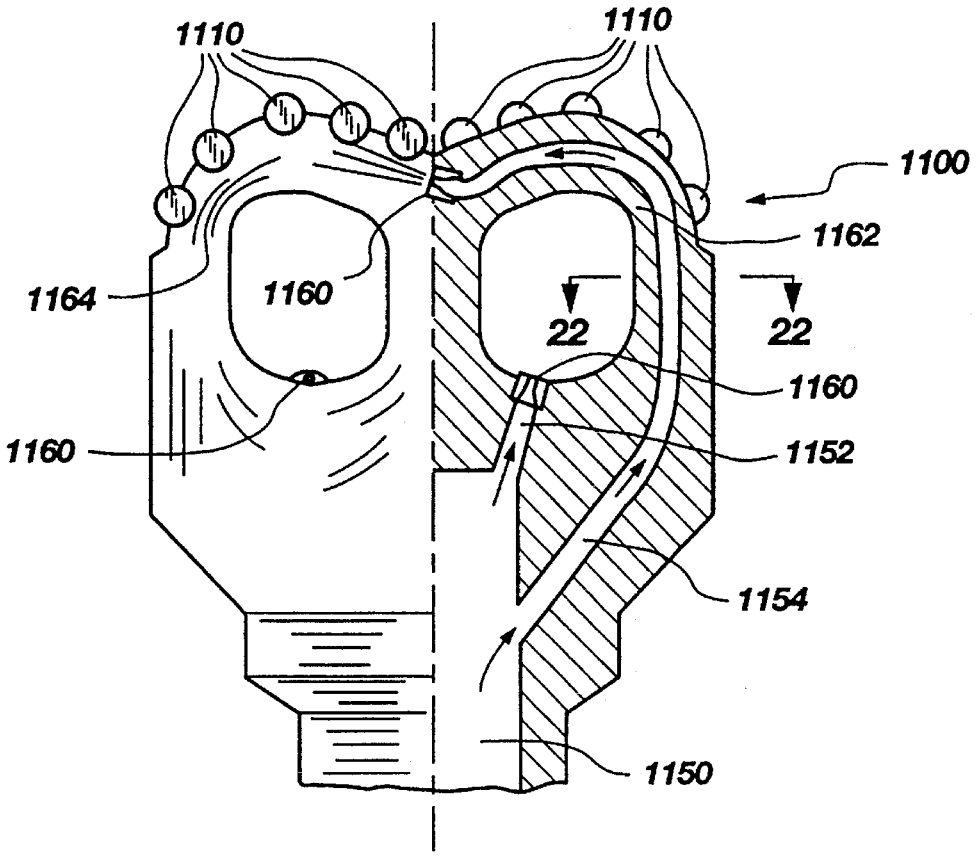
FIG. 21 comprises a partial sectional elevation of a rotary drill bit having passages therein to facilitate heat transfer from cutting elements to drilling fluid flowing through the passages.
Figure 22:
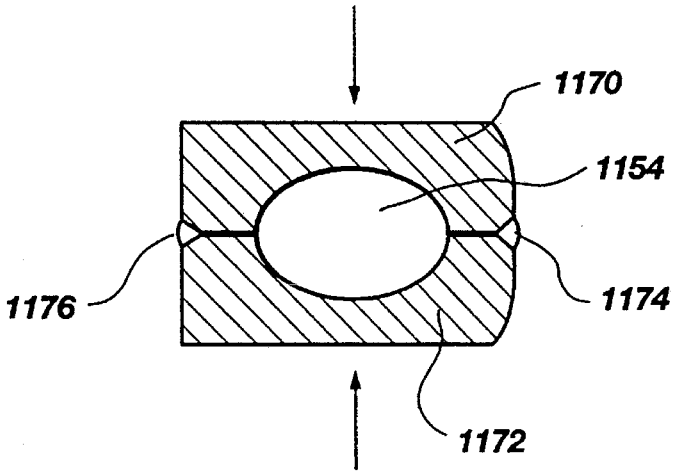
FIG. 22 is a section taken across line 22—22 on FIG. 21.

FIGS. 21 and 22 depict a rotary drill bit 1100 having a plurality of superhard cutting elements 1110 mounted thereon. As shown, bit 1100 includes a plenum 1150 from which several fluid passages 1152 and 1154 extend, passages 1152 and 1154 terminating, as is usually the case with such bits, in nozzles 1160. Passage 1152 takes a relatively short path to the bit exterior, while passage 1154 extends around the periphery of the bit profile just under the surface of the bit blade 1162 so that drilling fluid passing therethrough absorbs heat from cutting elements 1110 on that bit blade 1162. After traveling through passage 1154, the drilling fluid then exits to cool and clean cutting elements 1110 on adjacent blade 1164. Of course, cutting elements 1110 and the bit blades may include other heat transfer structure as previously disclosed. As shown in FIG. 22, bit blades such as 1162 and 1164 may be cast in two pieces 1170 and 1172, and then be welded or otherwise bonded at 1174 and 1176 together to define passage 1154 therebetween. Of course, blades or other bit components or an entire bit body containing passages for cooling purposes may be fabricated by any means or method known in the art, including casting, machining, information of a matrix material containing suitable preforms to define passages, or layered manufacturing techniques.

While the present invention has been described in terms of a plurality of illustrated embodiments, those of ordinary skill in the art will recognize and appreciate that it is not so limited. Many additions, deletions and modifications to these embodiments may be made without departing from the scope of the invention as hereinafter claimed. For example, the superhard reinforcing struts or portions thereof, such as webs, may have irregular surfaces such as waves or ridges; the struts may have a non-planar configuration, such as a cross- or X-shape when viewed from the rear; the struts may taper from top to bottom, or vice-versa, or be thicker at the top and bottom and narrow at the middle, or the reverse; the struts may be eccentrically placed to accommodate the cutting element's position on the bit and anticipated loads; and the superhard table may be of square, tombstone, semi-circular or other desired shape, as known in the art.

What is claimed is:

1. A cutting element for a rotary drag bit for drilling subterranean formations, comprising:

a substantially planar table of superhard material; and at least one elongated strut member comprising at least one strut including a web, said at least one strut extending rearwardly from said table and at least partially thereacross.

2. The cutting element of claim 1, wherein said table is substantially circular, and said at least one strut comprises a single, diametrically disposed strut.

3. The cutting element of claim 2, further including a substrate supporting said table from the rear, the web of said single, diametrically disposed strut extending into said substrate.

4. The cutting element of claim 1, wherein said at least one strut member comprises a plurality of laterally adjacent struts.

5. The cutting element of claim 4, further including a substrate supporting said table from the rear, the webs of said plurality of struts extending into said substrate.

6. The cutting element of claim 5, further including at least one passage proximate the rear of said table and defined between the webs of two of said laterally adjacent struts.

7. The cutting element of claim 1, wherein said at least one elongated strut member is of the same material as said table.

8. The cutting element of claim 7, wherein said at least one elongated strut member is integral with said table.

9. The cutting element of claim 1, wherein said at least one elongated strut member comprises a single, diametrically disposed strut extending at least partially across the rear of said table, said strut having an enlarged base portion abutting said table and tapering into said web.

10. The cutting element of claim 9, wherein said strut further includes an enlarged tail portion to the rear of said web.

11. The cutting element of claim 1, wherein said table is substantially circular and said at least one elongated strut member comprises a plurality of radially-extending struts.

12. The cutting element of claim 1, wherein said at least one strut includes at least one cavity in the web thereof.

13. The cutting element of claim 12, wherein said at least one cavity comprises an aperture extending through said at least one strut.

14. The cutting element of claim 1, wherein said at least one strut member is adapted to reinforce said table against bending stresses.

15. The cutting element of claim 1, wherein said at least one strut member is adapted to transfer heat away from said table.

16. The cutting element of claim 1, further including a substrate supporting said table from the rear, wherein said at least one elongated strut member extends to the rear of said substrate.

17. The cutting element of claim 1, further including a substrate supporting said table from the rear, wherein said substrate covers the rear extent of said at least one elongated strut member.

18. A cutting element for a rotary drag bit for drilling subterranean formations, comprising:

a substantially planar table of superhard material;

a grid-like substrate having a plurality of apertures therein in transverse orientation to and in communication with the rear of said table; and strut members comprising plugs disposed in said plurality of substrate apertures.

19. The cutting element of claim 18, wherein said cutting element is substantially circular and at least some of said plurality of apertures are disposed adjacent the periphery of said table.

20. The cutting element of claim 18, wherein said plugs comprise means for transferring heat away from said table.

21. A cutting structure for a rotary drag bit for drilling subterranean formations, comprising:

a substantially planar table of superhard material having a cutting face on one side thereof and a cutting edge at the periphery thereof adjacent said cutting face;

a substrate supporting said table on the side thereof opposite said cutting face; and structure for conducting heat away from said table extending through said substrate to an outer surface of said substrate not in contact with said table.

22. The cutting structure of claim 21, wherein said structure for conducting heat is located on the side of said table opposite said cutting face.

23. The cutting structure of claim 22, further including a carrier for mounting said table via said substrate on a rotary drag bit, said carrier including an interface for receiving heat from said heat conducting structure.

24. The cutting structure of claim 23, further including structure for dissipating heat from said carrier into the body of said rotary drag bit.

25. A cutting structure for a rotary drag bit for drilling subterranean formations, comprising:

a substantially planar table of superhard material having a cutting face on one side thereof and a cutting edge at the periphery thereof adjacent said cutting face;

structure for conducting heat away from said table located at the periphery of said table and extending away from said table for dissipating heat remotely therefrom.

26. The cutting structure of claim 25, wherein said structure for dissipating heat is adapted to be disposed in the body of said rotary drag bit.

27. A cutting structure for a rotary drag bit for drilling subterranean formations, comprising:

a substantially planar table of superhard material having a cutting face on one side thereof and a cutting edge at the periphery thereof adjacent said cutting face:

a substrate supporting said table; and structure for conducting heat away from said table in contact with the exterior of said substrate.

28. The cutting structure of claim 27, wherein said structure for conducting heat includes a cradle for receiving at least a portion of said substrate.

29. The cutting structure of claim 27, wherein said structure for conducting heat includes at least one fin adapted for disposition in a body of said rotary drag bit.

30. The cutting structure of claim 29, wherein said at least one fin comprises a plurality of laterally adjacent fins.

31. A drill bit for drilling subterranean formations, comprising:

a bit body having a face defining a profile;

at least one cutting element mounted on said bit face, said at least one cutting element including a substantially planar table of superhard material; and at least one stiffening member extending substantially transversely to said superhard material table and to the rear thereof for reinforcing said table against bending stresses.

32. The drill bit of claim 31, wherein said at least one stiffening member is adapted for conducting heat away from said table.

33. The drill bit of claim 31, wherein said at least one stiffening member is oriented substantially perpendicular to said profile.

34. A drill bit for drilling subterranean formations, comprising:

a bit body having a cavity therein for containing drilling fluid;

at least one cutting element mounted on a carrier structure, said carrier structure being adapted to transfer heat from said cutting element; and said carrier structure being mounted to said bit body and in communication with said body cavity.

35. The drill bit of claim 34, further including a passage extending from said body cavity through said carrier structure to said cutting element, and said cutting element includes a blind cavity therein communicating with said passage.

36. The drill bit of claim 34, wherein said carrier structure comprises a preform element.

37. The drill bit of claim 36, wherein said preform element includes heat dissipation structure projecting into said body cavity.

38. The drill bit of claim 37, wherein said heat dissipation structure comprises a plurality of fins.

39. A cutting element for a rotary drag bit for drilling subterranean/formations, comprising:

a substantially planar table of superhard material;

a substrate supporting said table from the rear; and at least one elongated strut member extending rearwardly from said table to the rear of said substrate.

40. The cutting element of claim 39, wherein said table is substantially circular and said at least one elongated strut member comprises at least one annular strut.

41. The cutting element of claim 40, wherein said at least one annular strut is of lesser diameter than said table.

* * * * *